US008376461B2

(12) United States Patent
Chen

(10) Patent No.: US 8,376,461 B2
(45) Date of Patent: Feb. 19, 2013

(54) CHILD SEAT CONVERTIBLE BETWEEN A HIGH CHAIR CONFIGURATION AND A SWING CONFIGURATION AND METHOD OF CONVERSION THEREOF

(75) Inventor: Shun-Min Chen, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 468 days.

(21) Appl. No.: 12/701,204

(22) Filed: Feb. 5, 2010

(65) Prior Publication Data

US 2010/0320810 A1 Dec. 23, 2010

(30) Foreign Application Priority Data

Jun. 17, 2009 (CN) ..... 2009 1 0149133

(51) Int. Cl.
*A47C 1/00* (2006.01)
*A47C 13/00* (2006.01)

(52) U.S. Cl. ..... 297/344.18; 297/130; 472/118; 472/119

(58) Field of Classification Search ..... 297/130, 297/344.18; 472/118, 119
See application file for complete search history.

(56) References Cited

U.S. PATENT DOCUMENTS 5,533,936 A * 7/1996 Julien et al. ..... 472/118
5,791,999 A * 8/1998 Lauro et al. ..... 472/118
6,421,901 B2 7/2002 Sitarski et al.
6,511,123 B1 * 1/2003 Sitarski et al. ..... 297/130 X
7,810,885 B2 * 10/2010 Chen et al. ..... 297/344.18

* cited by examiner

*Primary Examiner* — Anthony D Barfield
(74) *Attorney, Agent, or Firm* — Frommer Lawrence Haug LLP; Ronald R. Santucci

(57) ABSTRACT

A child seat includes a main support frame, a swing frame connected pivotally to the main support frame, a seat frame connected to the swing frame and convertible between a high chair configuration and a swing configuration, a first locking mechanism including a latch disposed movably between the swing frame and the main support frame and engaged releasably with the main support frame, and a second locking mechanism including a protrusion provided on the swing frame and movable between a first position, where movement of the latch is prevented, and a second position, where movement of the latch is permitted so that the latch can move away from the main support frame, thereby converting the seat frame to the swing configuration.

22 Claims, 11 Drawing Sheets

CHILD SEAT CONVERTIBLE BETWEEN A HIGH CHAIR CONFIGURATION AND A SWING CONFIGURATION AND METHOD OF CONVERSION THEREOF

CROSS-REFERENCE TO RELATED APPLICATION

This application claims priority of Chinese Patent Application No. 200910149133.4, filed on Jun. 17, 2009, the disclosure of which is incorporated herein by reference.

BACKGROUND OF THE INVENTION

1. Field of the Invention

This invention relates to a child seat, more particularly to a child seat that is convertible between a high chair configuration and a swing configuration and the method of conversion thereof.

2. Description of the Related Art

Referring to FIG. 1, a convertible swing/highchair, as disclosed in U.S. Pat. No. 6,421,901, includes a main support frame 11, a swing frame 12 connected pivotally to the main support frame 11, a seat frame 13 connected slidably to the swing frame 12, and two retractable rods 14 for fixing the swing frame 12 to the main support frame 11. When the retractable rods 14 are extended, the swing frame 12 is fixed to the main support frame 11. When the retractable rods 14 are retracted, the swing frame 12 is swingable relative to the main support frame 11. When the swing frame 12 is in a swing configuration, the seat frame 13 is slid to a lowest position of the swing frame 12. When the swing frame 12 is in a high chair configuration, the seat frame 13 is slid to a highest position of the swing frame 12.

Although the aforesaid convertible swing/high chair can achieve its intended purpose, it is possible for the retractable rods 14 to be operated accidentally such that the swing frame 12 is released from the main support frame 11. This poses a safety risk to the child seated on the convertible swing/high chair.

SUMMARY OF THE INVENTION

An object of the present invention is to provide a child seat that has a double lock effect so that the child seat is safe to use.

Another object of the present invention is to provide a child seat that is convertible between a high chair configuration and a swing configuration and the method of conversion thereof.

According to one aspect of this invention, a child seat comprises a main support frame including two spaced-apart support legs, a swing frame including two spaced-apart hanging rods having top ends connected pivotally to the main support frame, and a cross rod interconnecting bottom ends of the hanging rods, a seat frame mounted adjustably to the swing frame, and a locking device including a latch disposed movably in the cross rod and having an outer end extendible outward and sideward of the cross rod to engage releasably one of the support legs, and a protrusion extendible outwardly and upwardly of the cross rod to prevent movement of the latch relative to the cross rod, a pusher connected movably to the bottom end of one of the hanging rods and having a push rod to push the protrusion into the cross rod so as to permit movement of the latch within the cross rod, and an operating member provided on the cross rod and operable to move the outer end of the latch away from the one of the support legs when the push rod pushes the protrusion into the cross rod, so that the latch disengages from the one of the support legs.

According to another aspect of this invention, a child seat comprises a main support frame, a swing frame connected pivotally to the main support frame, a seat frame connected to the swing frame and convertible between a high chair configuration and a swing configuration, a first locking mechanism including a latch disposed movably between the swing frame and the main support frame and engaged releasably with the main support frame, and a second locking mechanism including a protrusion provided on the swing frame and movable between a first position, where movement of the latch is prevented, and a second position, where movement of the latch is permitted so that the latch can move away from the main support frame, thereby converting the seat frame to the swing configuration.

According to yet another aspect of this invention, a child seat convertible between a high chair configuration and a swing configuration comprises a main support frame, a swing frame including two spaced-apart hanging rods having top ends connected pivotally to the main support frame, and a cross rod interconnecting bottom ends of the hanging rods, a seat frame mounted to the swing frame and movable along the hanging rods between a first seat position and a second seat position, and a latch provided on the cross rod and having an outer end engageable releasably with the main support frame, and a protrusion engageable with the cross rod to prevent movement of the latch relative to the cross rod. When the seat frame is in the first seat position, the protrusion is engaged to the cross rod and the outer end of the latch is engaged to the main support frame. When the seat frame is in the second seat position, the protrusion is disengaged from the cross rod, so that the outer end of the latch is movable away from the main support frame, thereby converting the child seat to the swing configuration.

According to still another aspect of this invention, a method for converting a child seat between a high chair configuration and a swing configuration comprises the steps of: providing a main support frame, a swing frame connected pivotally to the main support frame and including two hanging rods and a cross rod interconnecting bottom ends of the hanging rods, and a seat frame connected to the hanging rods; providing a first locking mechanism on the swing frame to lock the swing frame relative to the main support frame; providing a second locking mechanism on the swing frame to limit the first locking mechanism to a locking position; providing the seat frame with a first height position for the high chair configuration and a second height position for the swing configuration; moving the seat frame from the first height position to the second height position to remove limiting of the first locking mechanism by the second locking mechanism; and operating the first locking mechanism to an unlock position so that the swing frame is swingable relative to the main support frame, and the child seat is converted from the high chair configuration into the swing configuration.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
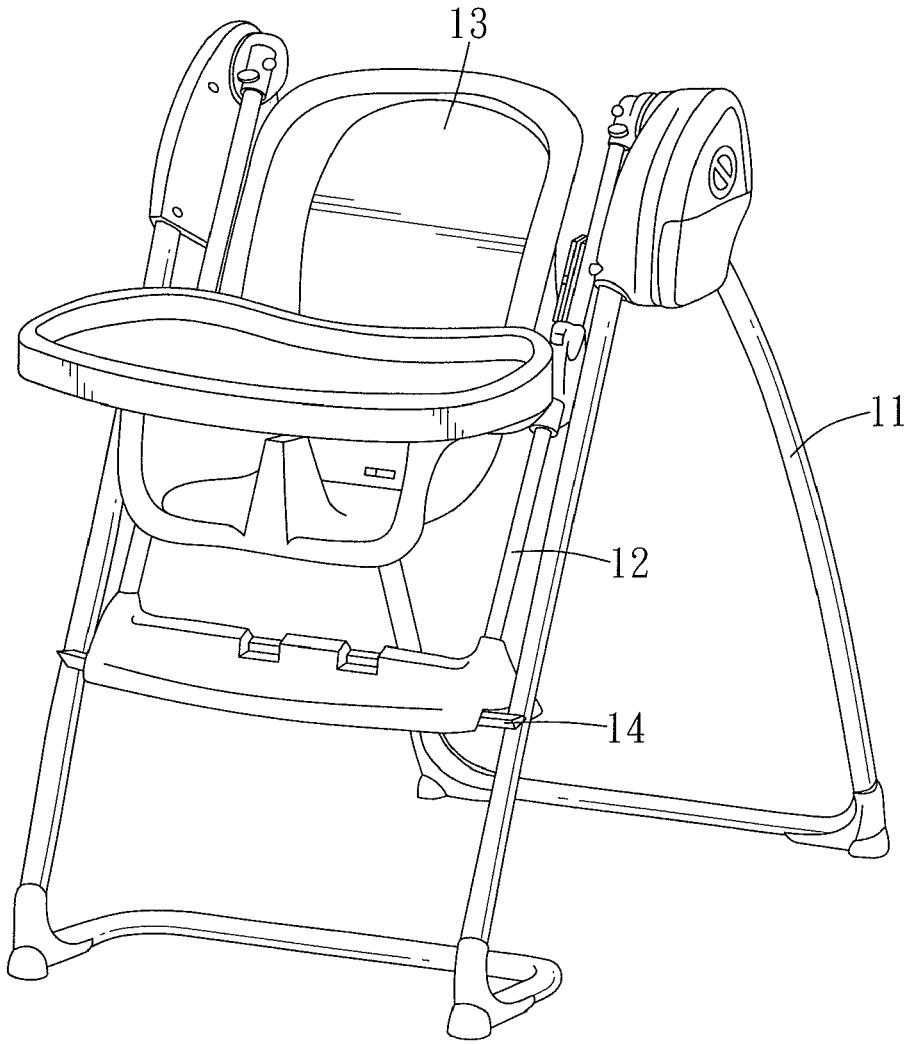
FIG. 1 PRIOR ART
FIG. 1 is a perspective view of a convertible swing/highchair disclosed in U.S. Pat. No. 6,421,901.

Before the present invention is described in greater detail, it should be noted that the same reference numerals have been used to denote like elements throughout the specification.

Referring to FIGS. 2 to 8, a child seat 100 according to the first preferred embodiment of the present invention is shown to comprise a main support frame 2, a swing frame 3, a seat frame 4, two mounting units 57, and a locking device 5. The child seat 100 is convertible between a high chair configuration (see FIG. 2), where the seat frame 4 and the swing frame 3 are fixed relative to the main support frame 2, and a swing configuration (see FIG. 3), where the seat frame 4 and the swing frame 3 are movable forwardly and rearwardly relative to the main support frame 2.

The main support frame 2 includes a front leg frame 26, a rear leg frame 27, and two leg pivot units 25. The front leg frame 26 has two spaced-apart front support legs 21, two wheel seats 23 connected respectively to bottom ends of the front support legs 21, and a front transverse rod 28 connected between the wheel seats 23. The rear leg frame 27 has two spaced-apart rear support legs 22, two ground stays 24 connected respectively to bottom ends of the rear support legs 22, and a rear transverse rod 29 connected between the ground stays 24. Each leg pivot unit 25 interconnects a top end of one of the front support legs 21 and a top end of a corresponding rear support leg 22, so that the front and rear leg frames 26, 27 are foldable and unfoldable relative to each other. Each front support leg 21 is formed with a positioning slot 211.

Figure 8:
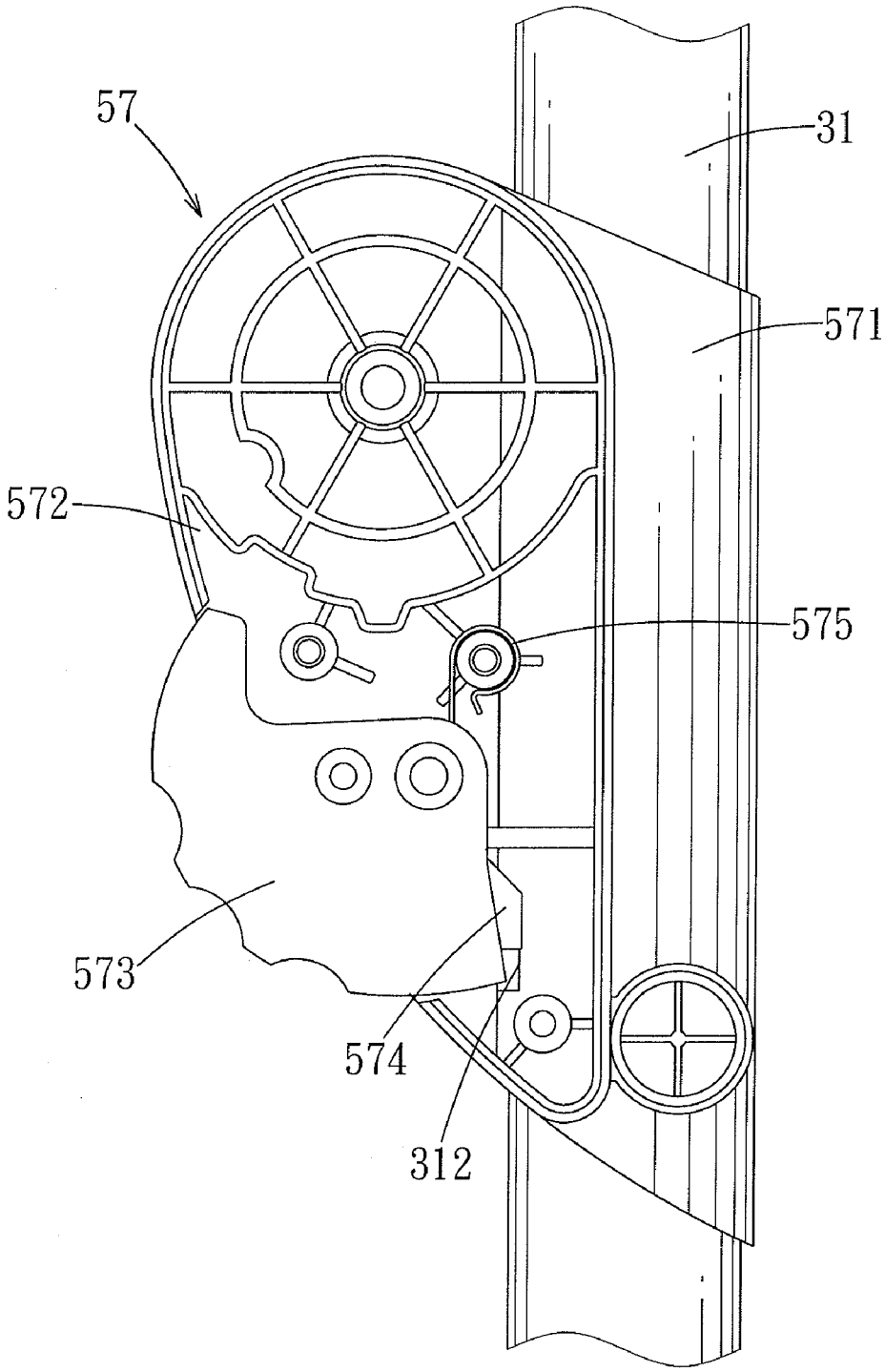
FIG. 8 is a schematic view of a mounting unit of the first preferred embodiment sleeved on a hanging rod.

The swing frame 3 has a substantially U-shaped configuration, and includes two swing pivot units 30 connected pivotally and respectively to the leg pivot units 25, two spaced-apart hollow hanging rods 31 having top ends connected fixedly and respectively to the swing pivot units 30, two three-way connectors 33, and a hollow cross rod 32. In this embodiment, each hanging rod 31 has a peripheral wall 310 provided with two diametrically opposed longitudinal holes 311 (see FIGS. 4 and 5) proximate to a bottom end thereof, and a plurality of engaging grooves 312 (only one is shown in FIG. 8) spaced apart from each other along the length of a corresponding hanging rod 31. Each three-way connector 33 has a first port 331 that receives fixedly a bottom end of a respective hanging rod 31, a second port 332 transverse and proximate to the first port 331, and a third port 333 opposite to the second port 332 and distal from the first port 331. The cross rod 32 in this embodiment includes two cross rod sections 320, 320' each having a first end inserted fixedly into the second port 332 through the third port 333 of a respective three-way connector 33, and a second end opposite to the first end. Each cross rod section 320, 320' further has an aperture 321, 321' (see FIGS. 4 and 5) formed in proximity to the first end thereof.

The seat frame 4 includes a seat body 41, a small tray 43 mounted on the seat body 41, and a large tray 42 disposed over the small tray 43.

A motor (not shown) may be provided on one of the swing pivot units 30 so as to activate the swing frame 3 and the seat frame 4 to move forward and rearward relative to the main support frame 2 when the child seat 100 is placed in the swing configuration.

Figure 2:
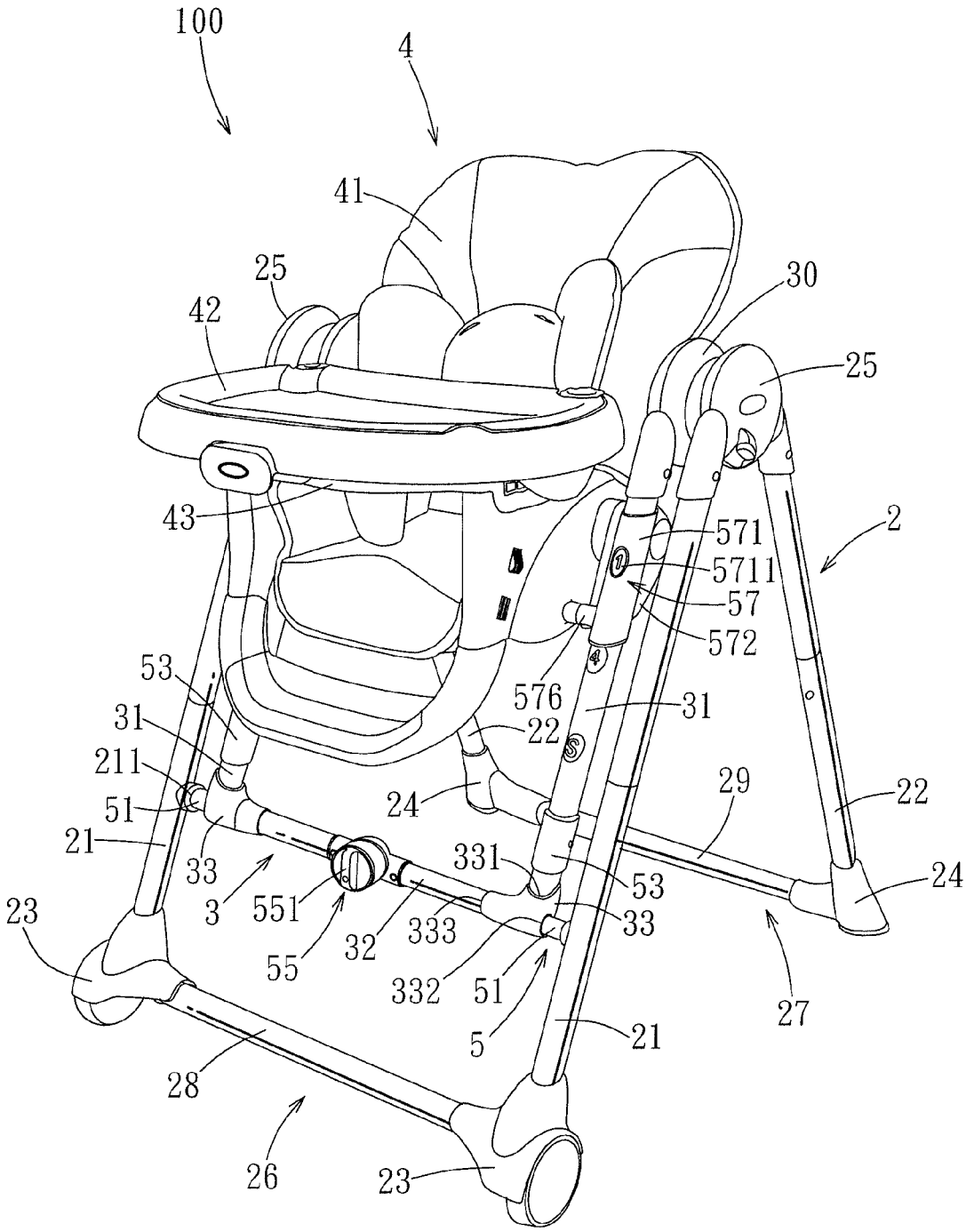
FIG. 2 is a perspective view of a child seat according to the first preferred embodiment of this invention in a high chair configuration.

Two mounting units 57 are provided to mount adjustably the seat frame 4 to the swing frame 3. The mounting units 57 are connected fixedly and respectively to two opposite lateral sides of the seat frame 4, and are connected slidably and respectively to the hanging rods 31. Each mounting unit 57 includes a tubular sleeve 571 sleeved slidably around a respective hanging rod 31, a first connecting portion 572 connected to the tubular sleeve 571 and a respective lateral side of the seat frame 4, and a second connecting portion 576 extending from the tubular sleeve 571 and connected to the respective lateral side of the seat frame 4. In this embodiment, each hanging rod 31 is provided with five different height positions represented respectively by numerals 1, 2, 3, 4, and the letter "S" (for "swing"). Each mounting unit 57 further has a view hole 5711 formed in the tubular sleeve 571 to allow for viewing of a selected height position. When the child seat 100 is in the high chair configuration, as shown in FIG. 2, the seat frame 4 can be positioned by the mounting units 57 to a selected one of the numerals 1~4 positions, where numeral 1 is the highest position. When the child seat 100 is converted from the high chair configuration to the swing configuration, the seat frame 4 is positioned in the letter "S" position which is the lowest position.

As shown in FIG. 8, each mounting unit 57 further includes a trigger member 573 connected pivotally to the first connecting portion 572, an engaging piece 574 fixed to the trigger member 573 and engaged selectively to one of the engaging grooves 312 in the respective hanging rod 31, and a torsion spring 575 biasing the trigger member 573 to move toward the respective hanging rod 31. Through engagement of the engaging piece 574 to one of the engaging grooves 312, the mounting unit 57 can be fixed to the respective hanging rod 31, thereby positioning the seat frame 4 to a selected height position. By pressing the trigger member 573, the engaging piece 574 can be moved away from said one of the engaging grooves 312 so as to facilitate sliding movement of the mounting unit 57 relative to the respective hanging rod 31 to thereby adjust the seat frame 4 to another desired height position.

The locking device 5 includes a first locking mechanism to lock movement of the swing frame 3 relative to the main support frame 2, and a second locking mechanism serving as a safety lock. The first locking mechanism can be unlocked only after the second locking mechanism is unlocked.

Figure 6:
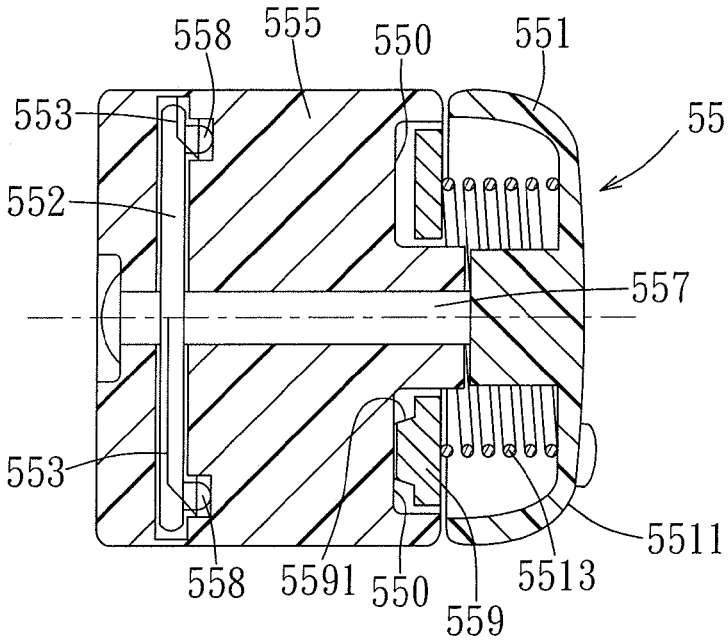
FIG. 6 is a sectional view of an operating member of the first preferred embodiment.
Figure 7:
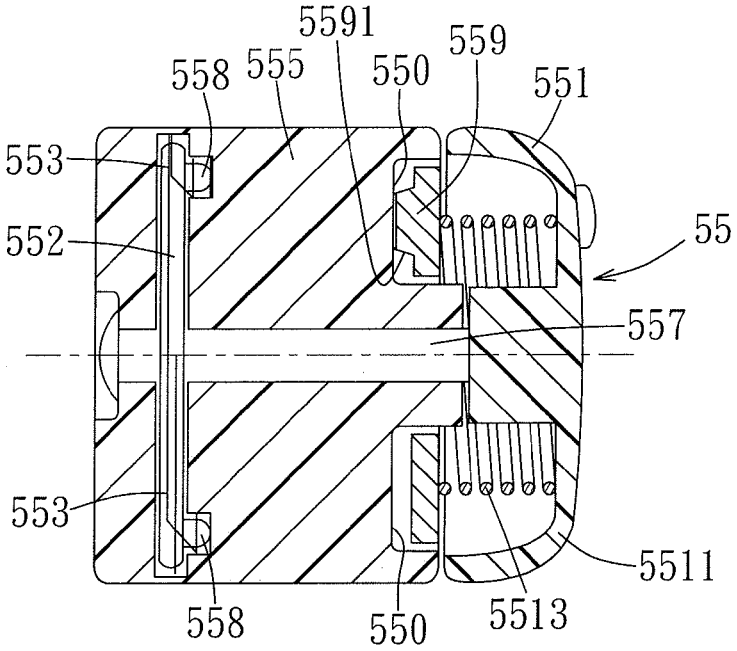
FIG. 7 is a view similar to FIG. 6, but illustrating connecting elements of the operating member wound around a reel disk thereof.

The first locking mechanism in this embodiment includes two latches 51, two spring elements 52, and an operating member 55. The latches 51 are disposed slidably, movably, and respectively in the cross rod sections 320, 320'. Each latch 51 is a hollow tube having a through hole 514 alignable with the aperture 321, 321' in a respective cross rod section 320, 320', and an outer end extendible outward and sideward of the respective cross rod section 320, 320' via the second port 332 to engage releasably the positioning slot 211 in one of the front support legs 21. A biasing element having a substantially V-shaped spring plate 513 is disposed within each latch 51. The operating member 55 includes a main body 555 having two opposite tubular sections 5551 extending oppositely therefrom, a spring-loaded rotary knob 551 having a shaft 557 connected rotatably to the main body 555, and a reel disk 552 fixed to the shaft 557 and rotatable along with the rotary knob 551. The main body 555, as shown in FIGS. 6 and 7, is formed with two diametrically opposed positioning grooves 550 each having a slanting surface (not visible). The rotary knob 551 includes a knob body 5511, a positioning ring member 559, and a spring 5513 disposed between the knob body 551 and the positioning ring member 559. The positioning ring member 559 has a protrusion 5591.

Figure 4:
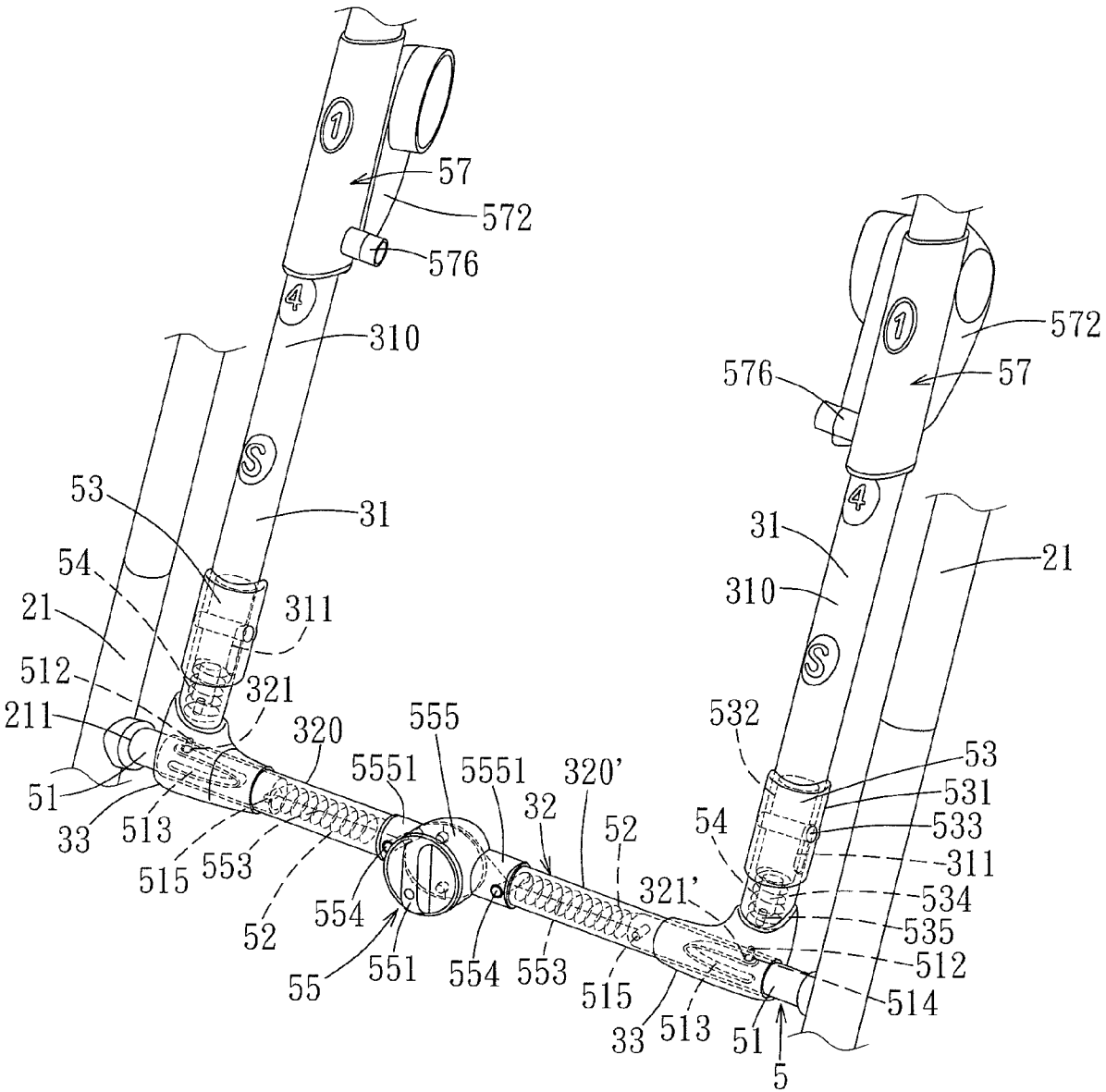
FIG. 4 is a fragmentary schematic view of the first preferred embodiment, illustrating latches of a first locking mechanism engaged respectively to support legs of a main support frame.

With reference to FIG. 6, in combination with FIG. 4, the protrusion 5591 is engaged to one of the positioning grooves 550, and the latches 51 are disposed in a locking position, that is, they are engaged respectively to the positioning slots 211 in the front support legs 21. When it is desired to release engagement of the latches 51 from the positioning slots 211 in the respective front support legs 21, the rotary knob 551 is rotated. As the rotary knob 551 is rotated, the protrusion 5591 moves out of one of the positioning grooves 550 by sliding along the slanting surface thereof, thereby compressing the spring 5513.

Figure 5:
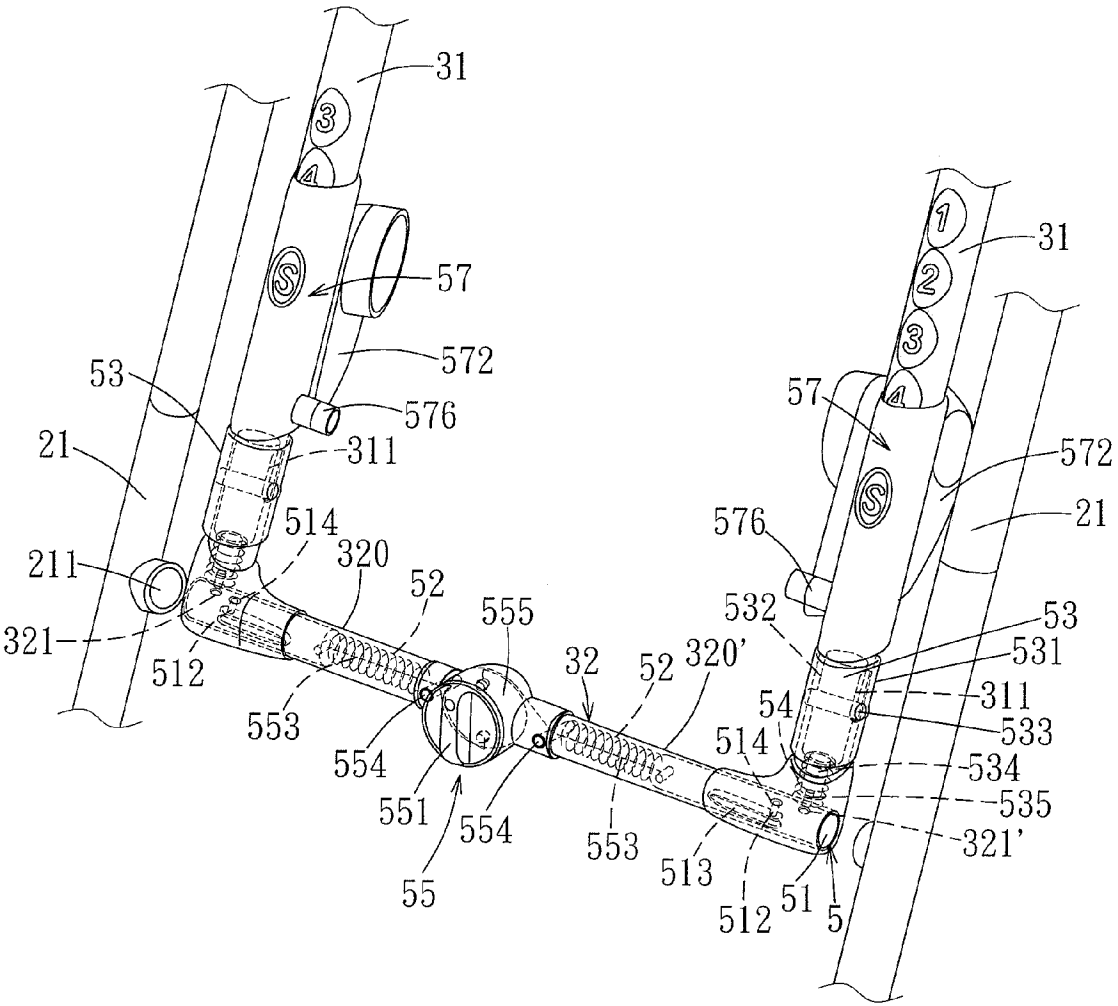
FIG. 5 is a view similar to FIG. 4, but illustrating the latches disengaged from the respective support legs.

When the rotary knob 551 is rotated by an angle of 180°, the protrusion 5591 is rotated to the other positioning groove 550, as shown in FIG. 7. At this time, the latches 51 are disengaged from the positioning slots 211 in the respective front support legs 21, as shown in FIG. 5.

The second ends of the cross rod sections 320, 320' are connected fixedly and respectively to the tubular sections 5551 through stop pins 554 so that the main body 555 is disposed between the cross rod sections 320, 320'. Each spring element 52 has two opposite ends abutting respectively against one of the stop pins 554 and an inner end of a respective latch 51, and biases the outer end of the respective latch 51 to engage the positioning slot 211 in one of the front support legs 21. The reel disk 552 is provided with two spaced-apart projections 558.

The operating member 55 further includes two connecting elements 553 connected to the reel disk 552 and connected respectively to the latches 51. In this embodiment, each connecting element 553 is a steel wire having one end connected to one of the projections 558 of the reel disk 552 and the other end connected to a fixed pin 515 that is provided in the respective latch 51 in proximity to the inner end thereof.

The second locking mechanism includes two protrusions 512 and two pushers 53. The protrusions 512 are provided within the respective latches 51 and are movable between first and second positions. In the first position, the protrusions 512 project outwardly and upwardly from the apertures 321, 321' in the respective cross rod sections 320, 320' so as to prevent movement of the latches 51 within the respective cross rod sections 320, 320'. In the second position, the protrusions 512 are retracted into the respective cross rod sections 320, 320' so as to permit movement of the latches 51 within the respective cross rod sections 320, 320'. In this embodiment, each protrusion 512 projects upwardly from an upper arm of the spring plate 513 in the respective latch 51, and is biased by the spring plate 513 to move outwardly of the aperture 321, 321' in the respective cross rod section 320, 320' when the through hole 514 and the aperture 321, 321' are aligned to each other so as to place the protrusion 512 in the first position.

The pushers 53 are connected movably and respectively to the bottom ends of the hanging rods 31. Each pusher 53 includes an outer tube 531 sleeved slidably around the peripheral wall 310, a core 532 sleeved slidably within the peripheral wall 310, a push rod 534 extending downwardly from the core 532, and a transverse pin 533 extending through the core 532 and the longitudinal holes 311 in the peripheral wall 310 and connected to the outer tube 531. The push rod 534 has a push pin 535 on a bottom end thereof. A resilient element 54, as shown in FIG. 4, is configured as a compression spring, is sleeved around the push rod 534 of each pusher 53, and normally biases the outer tube 531 to move upwardly until the transverse pin 533 abuts against top ends of the longitudinal holes 311 in the respective hanging rod 31.

With reference to FIGS. 2 and 4, when the child seat 100 is in the high chair configuration, the latches 51 are biased by the spring elements 52 to engage the positioning slots 211 in the respective front support legs 21, thereby preventing movement of the swing frame 3 relative to the main support frame 2. At this time, the positioning ring 559 is engaged to one of the positioning grooves 550. Further, since the mounting units 57 are disposed away from the pushers 53, the pushers 53 are biased by the resilient elements 54 to move upwardly, so that the protrusions 512 can be placed in the first position to thereby prevent movement of the latches 51 relative to the respective cross rod sections 320, 320'. Hence, a double lock effect is achieved at this time to prevent the swing frame 3 from moving relative to the main support frame 2.

Figure 3:
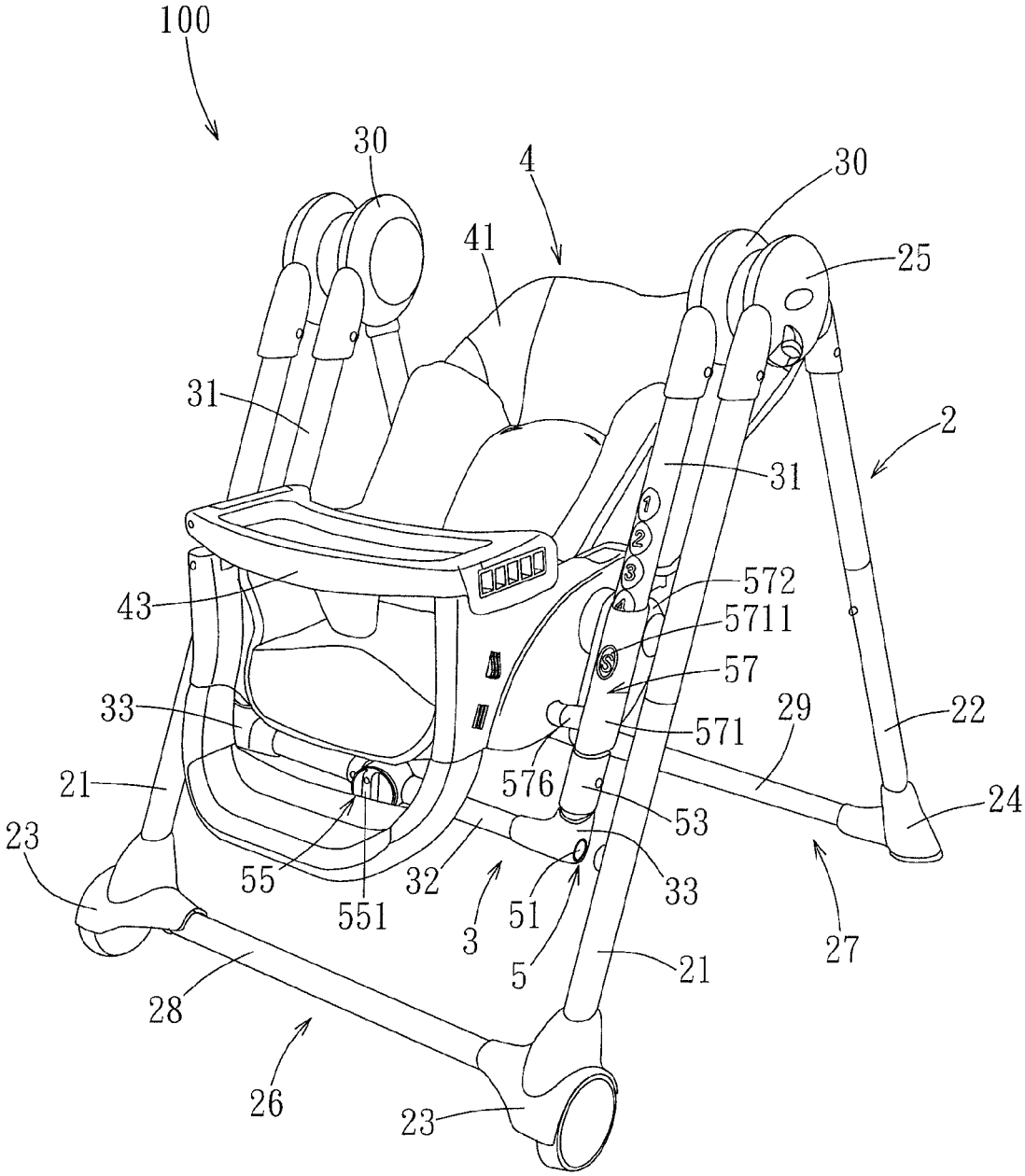
FIG. 3 is a view similar to FIG. 2, but illustrating the child seat in a swing configuration.

With reference to FIGS. 3, 5, and 7, when the child seat 100 is to be converted from the high chair configuration to the swing configuration, the large tray 42 (see FIG. 2) is first removed from the child seat 100, after which the mounting units 57 along with the seat frame 4 are slid down so as to be positioned at the "S" (or lowest) position. When the seat frame 4 reaches the lowest position, the mounting units 57 push the outer tubes 531 of the respective pushers 53 downwardly relative to the respective hanging rods 31, so that the push pins 535 of the pushers 53, in turn, can push the protrusions 512 downwardly into the respective cross rod sections 320, 320' to release engagement between the protrusion 512 and the respective cross rod section 320, 320', thereby permitting movement of the latches 51 within the respective cross rod sections 320, 320'. Next, the rotary knob 551 is rotated by an angle of 180° so as to rotate therealong the reel disk 552, and each latch 51 is pulled by the respective connecting element 553 to move the outer end thereof away from the positioning slot 211 in the respective front support leg 21 and into the respective cross rod section 320, 320', thereby disengaging the latches 51 from the respective front support legs 21. At this time, the positioning ring 559 is engaged to the other positioning groove 550. Hence, the swing frame 3 can be moved back and forth relative to the main support frame 2 at this time either by activating the drive mechanism 6 or by pushing the swing frame 3 manually.

It is worth mentioning that when the child seat 100 is to be converted back to the high chair configuration from the swing configuration, the rotary knob 551 is rotated reversely, and, through the restoring forces of the spring elements 52, the outer ends of the latches 51 are biased again to engage the positioning slots 211 in the respective front support legs 21. Further, the mounting units 57 are slid upwardly so as to place the seat frame 4 to a desired height position and so as to move away from the respective pushers 53, so that the protrusions 512 can be biased to extend outwardly of the apertures 321, 321' in the respective cross rod sections 320, 320' by the spring plates 513 in the respective latches 51. Hence, a double lock effect is again achieved.

The aforesaid double lock effect can be released only when the seat frame 4 is slid down to the lowest position and the rotary knob 551 is operated. That is, the rotary knob 551 cannot be operated unless the mounting units 57 are first slid down to the lowest position. Also, if the mounting units 57 are accidentally slid down to the lowest position, since the latches 51 are still engaged to the positioning slots 211 in the respective front support legs 21, the seat frame 4 or the swing frame 3 is still fixed to the main support frame 2. In such a state, only when the rotary knob 551 is operated can the latches 51 be disengaged from the positioning slots 211 in the respective front support legs 21. Hence, unlike the conventional convertible swing/high chair, the child seat 100 of the present invention is safe to use.

Referring to FIGS. 9 to 12, a child seat 100 according to the second preferred embodiment of the present invention is shown to be similar to the first preferred embodiment. The main difference between the first and second preferred embodiments resides in the method of disengaging the latches 51 from the respective front support legs 21. In this embodiment, the hollow cross rod 32 of the swing frame 3 has two opposite ends provided respectively with the apertures 321, 321', and an intermediate portion between the ends and provided with two pairs of diametrically opposed horizontal holes 322 each pair of which is formed in proximity to the corresponding aperture 321, 321', and two retaining holes 323 each formed in proximity to one of the pairs of the horizontal holes 322.

The first locking mechanism in this embodiment includes two operating members 55'. Each operating member 55' includes a body 555' sleeved slidably around the cross rod 32, a transverse pin 556 extending through the inner end of the respective latch 51 and a corresponding pair of the horizontal holes 322 in the cross rod 32 and connected to the body 555', and an operating element 551'. The operating element 551' is configured as a seesaw switch, and includes a seesaw plate 557 mounted pivotally to the body 555', an engaging pin 558 projecting from one side of the seesaw plate 557 and engaged releasably to one of the retaining holes 323 in the cross rod 32, and a compression spring 559 disposed on the other side of the seesaw plate 557 and biasing the engaging pin 558 to engage one of the retaining holes 323. When the engaging pin 558 is engaged to one of the retaining holes 323, the body 555' is fixed to the cross rod 32. By pressing the seesaw plate 557 at the side where the compression spring 559 is disposed, the engaging pin 558 can be disengaged from said one of the retaining holes 323 to permit sliding movement of the body 555' along the cross rod 32. When the engaging pin 558 is engaged to the other one of the retaining holes 323, the body 555' is again fixed to the cross rod 32.

Hence, when the seesaw plates 557 of the operating elements 551' are pressed simultaneously, the bodies 555' of the operating elements 551' can be moved to slide along the cross rod 32, and the latches 51 can be moved between a locking position and a releasing position relative to the respective front support legs 21. It is worth mentioning that in this embodiment, only one compression spring 52 is necessary. The compression spring 52 has two opposite ends abutting respectively against the inner ends of the latches 51 to bias the outer ends of the latches 51 to engage the positioning slots 211 (only one is visible in FIGS. 9 to 11) in the respective front support legs 21.

Figure 9:
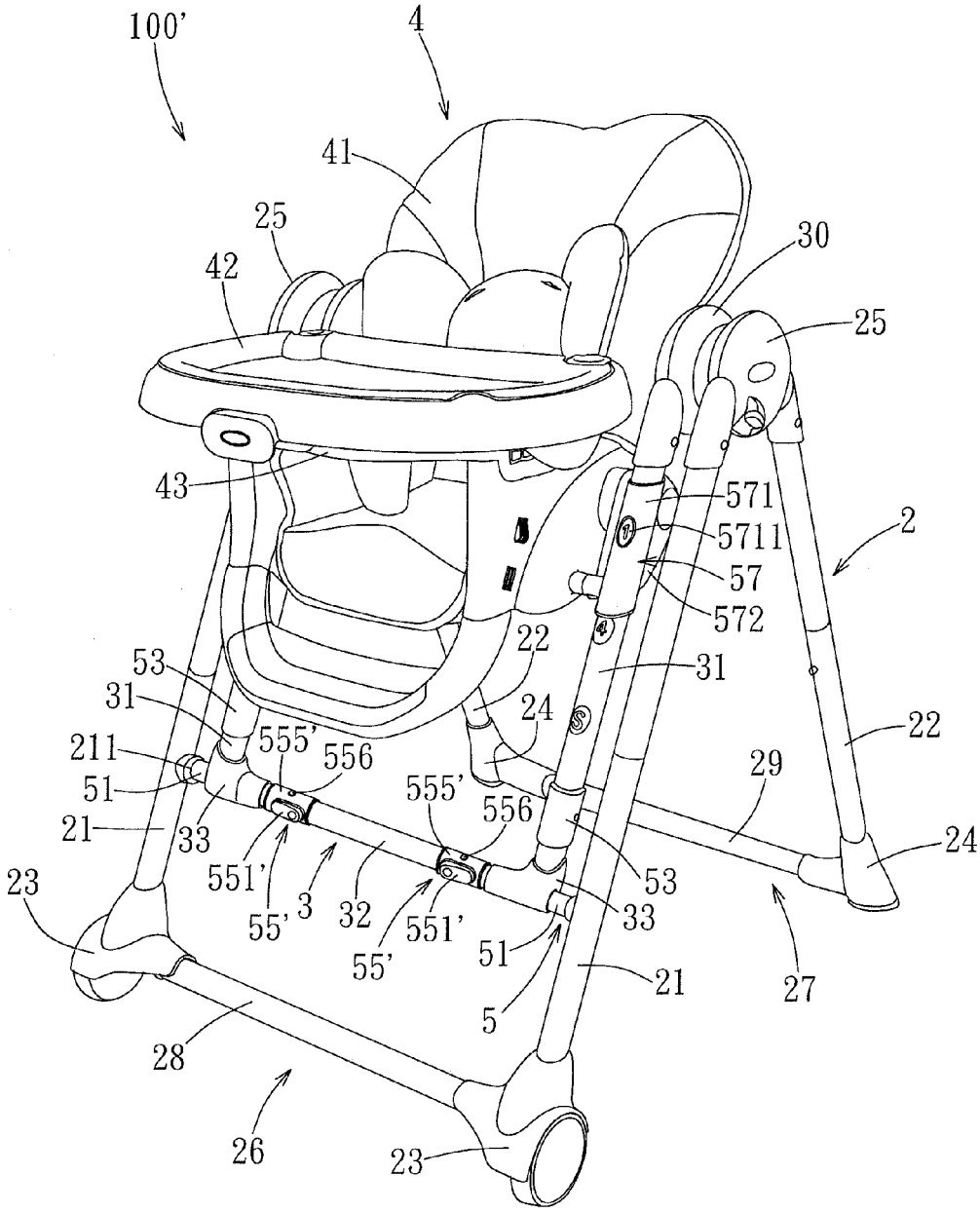
FIG. 9 is a perspective view of a child seat according to the second preferred embodiment of this invention.
Figure 10:
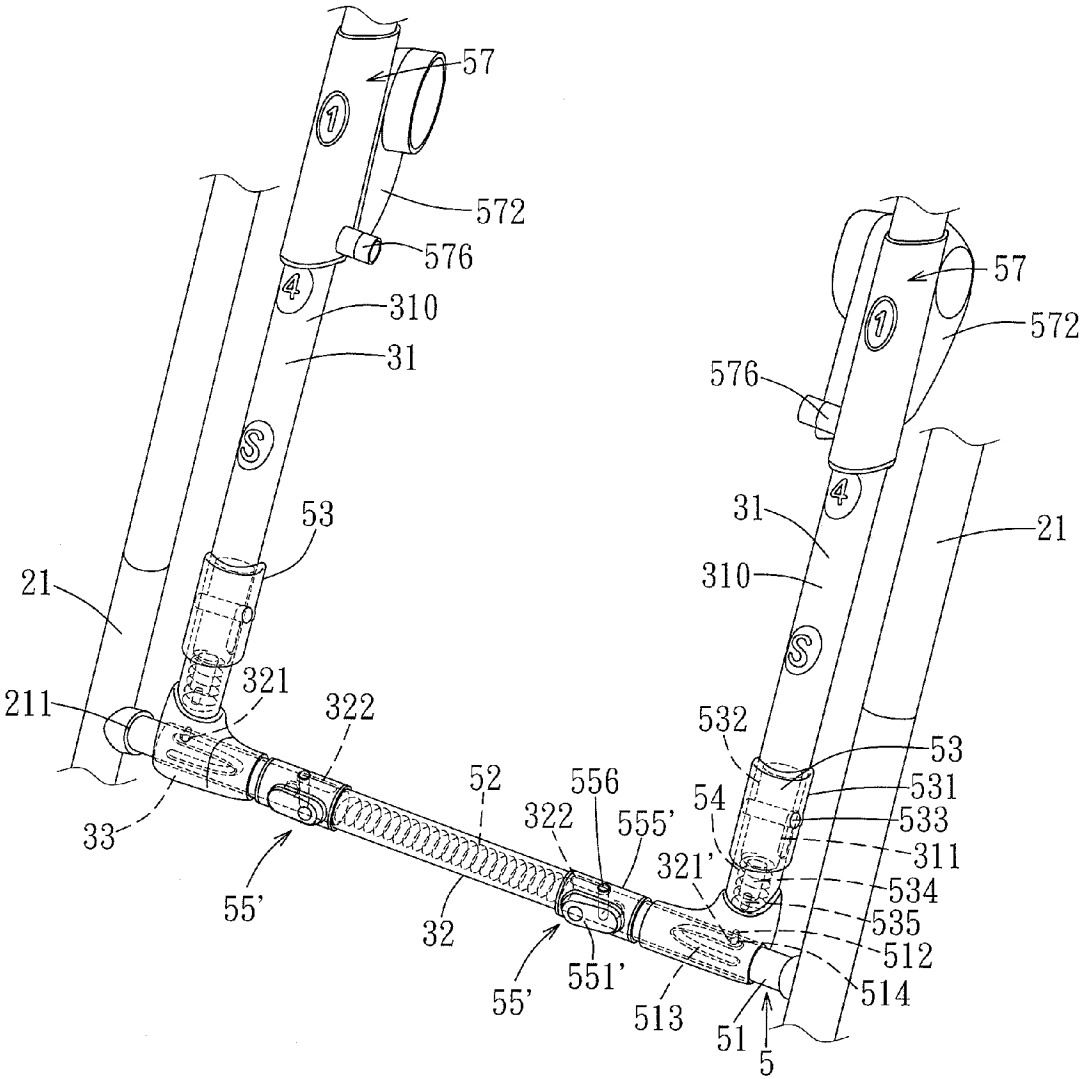
FIG. 10 is a fragmentary schematic view of the second preferred embodiment, illustrating latches of a first locking mechanism engaged respectively to support legs of a main support frame.

With reference to FIG. 10, in combination with FIG. 9, when the child seat 100 is in the high chair configuration, the outer ends of the latches 51 are engaged to the positioning slots 211 in the respective front support legs 21, and the protrusions 512 extend outwardly and respectively from the apertures 321, 321' in the cross rod 32, thereby preventing movement of the latches 51 within the cross rod 32. Hence, a double lock effect is achieved. At this time, the swing frame 3 is fixed to the main support frame 2.

Figure 11:
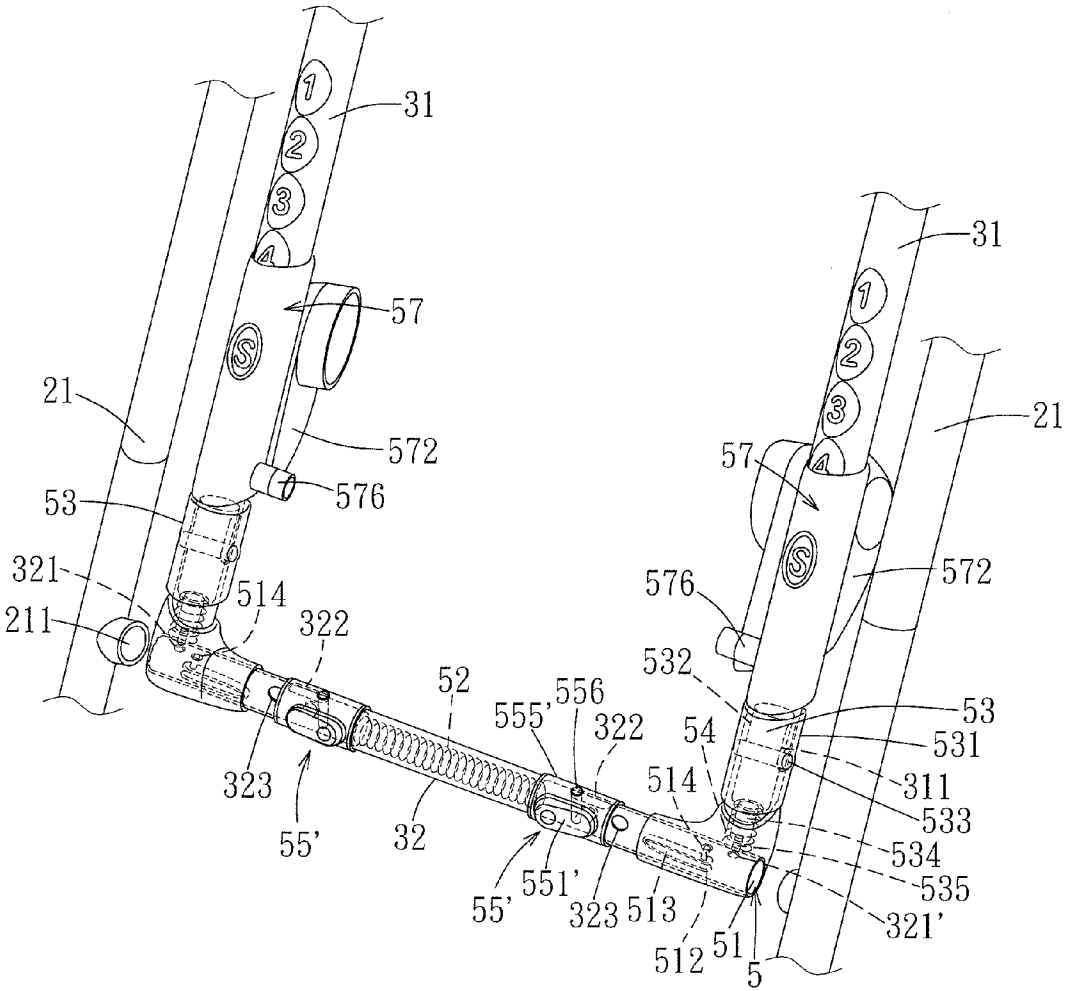
FIG. 11 is a view similar to FIG. 10, but illustrating the latches disengaged from the respective support legs.
Figure 12:
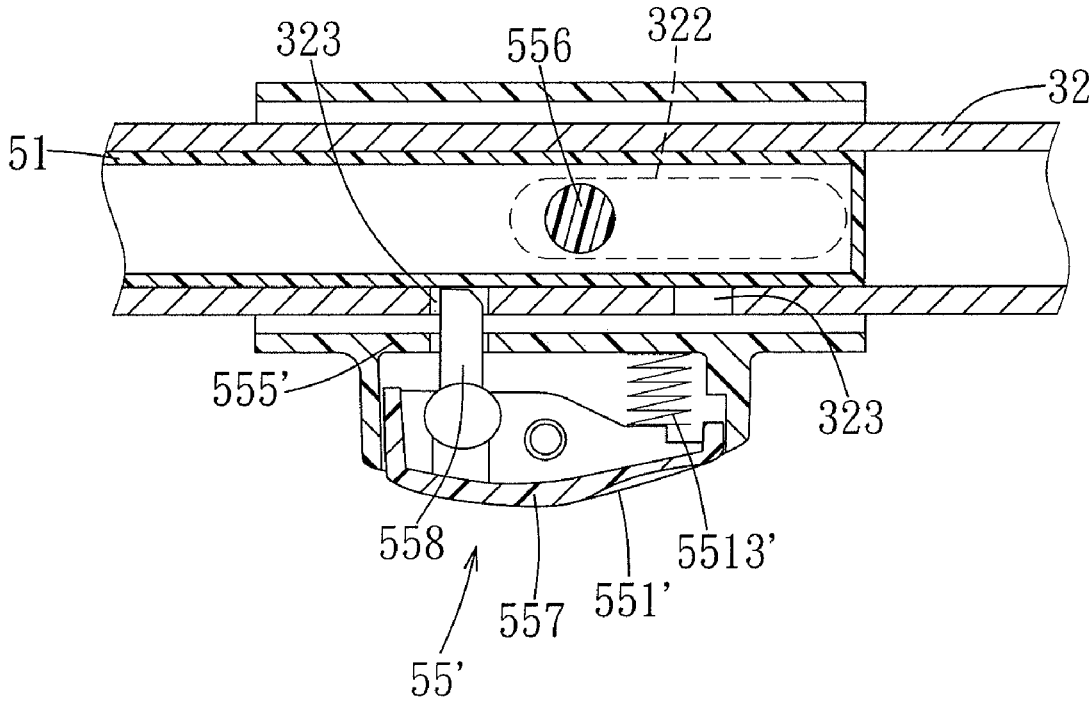
FIG. 12 illustrates how an operating member of the second preferred embodiment is connected to a cross rod of a swing frame.

With reference to FIG. 11, when the child seat 100 is converted from the high chair configuration to the swing configuration, the large tray 42 (see FIG. 2) is first removed, after which the mounting units 57 are slid downwardly to the "S" or lowest position so that the bottom end of the mounting units 57 push the pushers 53 downwardly. The push pins 535 of the pushers 53, in turn, push the protrusions 512 from the first position to the second position, thereby permitting movement of the latches 51 within the cross rod 32. Next, the seesaw plates 557 of the operating elements 551' are pressed simultaneously so as to move the bodies 555' toward each other, thereby moving the latches 51 away from the respective front support legs 21 and disengaging the outer ends of the latches 51 from the positioning slots 211 in the respective front support legs 21. The double lock effect is thus removed, and the swing frame 3 along with the seat frame 4 can be moved back and forth relative to the main support frame 2 by activating the drive mechanism 6 or by pushing the swing frame 3 manually.

It is worth mentioning that when the child seat 100 is to be converted back to the high chair configuration from the swing configuration, the seesaw plates 557 of the operating elements 551' are simultaneously pressed again so as to move the bodies 555' away from each other through the restoring force of the compression spring 52, thereby moving the latches 51 toward the respective front support legs 21 to engage the outer ends of the latches 51 with the positioning slots 211 in the respective front support legs 21. The mounting units 57 are then moved upwardly to the desired height position indicated on the respective hanging rods 31, so that the protrusions 512 can again extend outwardly and respectively from the respective apertures 321, 321' in the cross rod 32. As a result, the double lock effect is again achieved.

The method for converting the child seat 100 of the present invention from the high chair configuration to the swing configuration includes the following steps:

providing the main support frame 2, the swing frame 3 connected pivotally to the main support frame 2 and the swing frame 3 including the two hanging rods 31 and the cross rod 32 interconnecting bottom ends of the hanging rods 31, and the seat frame 4 connected to the hanging rods 31;

providing the first locking mechanism on the swing frame 3 to lock the swing frame 3 relative to the main support frame 2;

providing the second locking mechanism on the swing frame 3 to limit the first locking mechanism to a locking position;

providing the seat frame 4 with a first height position for the high chair configuration and a second height position for the swing configuration;

moving the seat frame 4 from the first height position to the second height position to remove limiting of the first locking mechanism by the second locking mechanism; and operating the first locking mechanism to an unlock position so that the swing frame 3 is swingable relative to the main support frame 2, and the child seat 100 is converted from the high chair configuration into the swing configuration.

The beneficial effect of the present invention resides in that through engagement of the outer ends of the latches 51 with the respective front support legs 21 of the main support frame 2 to prevent movement of the latches 51 relative to the respective front support legs 21, and through the extension of the protrusions 512 outwardly of the cross rod 32 to prevent movement of the latches 51 within the cross rod 32, a double lock effect is obtained. Such double lock effect can be released only when the seat frame 4 is slid to the "S" or lowest position so that the push pins 535 of the pushers 53 can push the respective protrusions 512 into the cross rod 32 to thereby permit movement of the latches 51 within the cross rod 32, and the rotary knob 551 or the operating element 551' is operated so as to move the latches 51 away from the respective front support legs 21, thereby disengaging the latches 51 from the respective front support legs 21.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A child seat comprising:

a main support frame including two spaced-apart support legs;

a swing frame including two spaced-apart hanging rods having top ends connected pivotally to said main support frame, and a cross rod interconnecting bottom ends of said hanging rods;

a seat frame mounted adjustably to said swing frame; and a locking device including a latch disposed movably in said cross rod and having an outer end extendible outward and sideward of said cross rod to engage releasably one of said support legs, a protrusion extendible outwardly and upwardly of said cross rod to prevent movement of said latch relative to said cross rod;

a pusher connected movably to said bottom end of one of said hanging rods and including a push rod to push said protrusion into said cross rod so as to permit movement of said latch within said cross rod; and an operating member provided on said cross rod and operable to move said outer end of said latch away from said one of said support legs when said push rod pushes said protrusion into said cross rod, so that said latch disengages from said one of said support legs.

2. The child seat of claim 1, further comprising two mounting units connected fixedly and respectively to two opposite lateral sides of said seat frame and connected slidably and respectively to said hanging rods, wherein when said seat frame is slid to a lowest position, said pusher is pushed downwardly by said mounting units so that said push rod pushes said protrusion into said cross rod to release engagement between said protrusion and said cross rod.

3. The child seat of claim 2, wherein said latch has a biasing element to bias said protrusion outwardly of said cross rod.

4. The child seat of claim 3, wherein said cross rod has an aperture, said latch having a through hole alignable with said aperture, said protrusion extending through said through hole and out of said aperture when said through hole and said aperture are aligned to each other to prevent movement of said latch relative to said cross rod.

5. The child seat of claim 3, wherein said biasing element is disposed within said latch, and has a substantially V-shaped spring plate, said protrusion being fixed to one arm of said V-shaped spring plate.

6. The child seat of claim 2, wherein said one of said hanging rods has a peripheral wall provided with two diametrically opposed longitudinal holes, said pusher further including an outer tube sleeved slidably around said peripheral wall, a core sleeved slidably within said peripheral wall, and a transverse pin extending through said core and said longitudinal holes and connected to said outer tube, said push rod extending downwardly from said core, one of said mounting units pushing said outer tube downwardly relative to said one of said hanging rods when said seat frame reaches the lowest position.

7. The child seat of claim 6, wherein said locking device further includes a resilient element normally biasing said outer tube to move upwardly.

8. The child seat of claim 1, wherein said locking device further includes a spring element to bias said outer end of said latch to engage said one of said support legs.

9. The child seat of claim 8, wherein said operating member is provided rotatably on said cross rod.

10. The child seat of claim 9, wherein said operating member includes a rotary knob, and a connecting element connected between said rotary knob and said latch, said rotary knob being rotatable so that said connecting element pulls said outer end of said latch into said cross rod and away from said one of said support legs.

11. The child seat of claim 8, wherein said operating member is provided slidably on said cross rod.

12. The child seat of claim 11, wherein said operating member includes a body sleeved slidably around said cross rod, and an operating element provided on said body, said latch being connected to said body, said operating element being operable to move said latch along said cross rod.

13. The child seat of claim 1, wherein said one of said support leg is provided with a positioning slot, and said latch is a hollow tube extendible releasably into said positioning slot.

14. A child seat comprising:

a main support frame;

a swing frame connected pivotally to said main support frame and including two hanging rods, and a cross rod interconnecting said hanging rods;

a seat frame connected to said swing frame and convertible between a high chair configuration and a swing configuration;

a first locking mechanism including a latch disposed movably between said swing frame and said main support frame and engaged releasable with said main support frame; and a second locking mechanism including a protrusion provided on said swing frame and movable between a first position, where movement of said latch is prevented, and a second position, where movement of said latch is permitted so that said latch can move away from said main support frame, thereby converting said seat frame to said swing configuration;

wherein said second locking mechanism further includes a pusher connected movably to one of said hanging rods and having a push rod to push said protrusion from said first position to said second position so as to permit movement of said latch.

15. The child seat of claim 14, wherein said protrusion is disposed in said cross rod, and extends outwardly from said cross rod when in said first position to prevent movement of said latch.

16. The child seat of claim 15, further comprising two mounting units connected fixedly and respectively to two lateral sides of said seat frame and connected slidably and respectively to said hanging rods, said mounting units being slidable along said hanging rods to move said seat frame between a highest position and a lowest position, said protrusion being in said second position when said seat frame is in said lowest position.

17. The child seat of claim 14, wherein said first locking mechanism further includes an operating member movably provided on said cross rod and operable to move said latch away from said main support frame.

18. A child seat convertible between a high chair configuration and a swing configuration, comprising:

a main support frame;

a swing frame including two spaced-apart hanging rods having top ends connected pivotally to said main support frame, and a cross rod interconnecting bottom ends of said hanging rods;

a seat frame mounted to said swing frame and movable along said hanging rods between a first seat position and a second seat position;

a latch provided on said cross rod and having an outer end engageable releasably with said main support frame and a protrusion engageable with said cross rod to prevent movement of said latch relative to said cross rod; and a pusher disposed movably on said bottom end of one of said hanging rods;

wherein, when said seat frame is in said first seat position, said protrusion is engaged to said cross rod and said outer end of said latch is engaged to said main support frame, and when said seat frame is in said second seat position, said protrusion is disengaged from said cross rod, so that said outer end of said latch is operably movable away from said main support frame, thereby converting said child seat to said swing configuration; and wherein said pusher has a push rod to push said protrusion when said seat frame is in said second seat position so as to disengage said protrusion from said cross rod.

19. The child seat of claim 18, further comprising an operating member provided on said cross rod, said operating member being operable to move said latch away from said main support frame when said protrusion is disengaged from said cross rod.

20. A method for converting a child seat between a high chair configuration and a swing configuration, comprising:

providing a main support frame, a swing frame connected pivotally to the main support frame and including two hanging rods and a cross rod interconnecting bottom ends of the hanging rods, and a seat frame connected to the hanging rods;

providing a first locking mechanism on the swing frame to lock the seat frame relative to the main support frame at a first height position for having the high chair configuration;

providing a second locking mechanism on the swing frame and the first locking mechanism to retain the first locking mechanism at a locking position;

moving the seat frame from the first height position to a second height position for having the swing configuration to cause the seat frame to actuate the second locking mechanism so that movement of the first locking mechanism from the locking position to an unlock position is permitted; and operating the first locking mechanism to move to the unlock position so that the swing frame is swingable relative to the main support frame, and the child seat is converted from the high chair configuration into the swing configuration.

21. The method of claim 20, wherein the first locking mechanism includes an operating member provided on the cross rod, rotating the operating member to operate the first locking mechanism to an unlock position.

22. The method of claim 20, wherein the first locking mechanism includes an operating member provided slidably on the cross rod, the operating member including a seesaw switch, pressing said seesaw switch and sliding the operating member to operate the first locking mechanism to an unlock position.

* * * * *